US006807884B2

(12) United States Patent
Sillman

(10) Patent No.: US 6,807,884 B2
(45) Date of Patent: Oct. 26, 2004

(54) FASTENER REMOVAL AND INSTALLATION TOOL

(75) Inventor: Eric Norman Sillman, Tuczon, AZ (US)

(73) Assignee: Raytheon Corp., Lexington, MA (US)

( * ) Notice: Subject to any disclaimer, the term of this patent is extended or adjusted under 35 U.S.C. 154(b) by 0 days.

(21) Appl. No.: 10/263,206

(22) Filed: Oct. 1, 2002

(65) Prior Publication Data

US 2004/0060400 A1 Apr. 1, 2004

(51) Int. Cl.[7] ..... B25B 23/00
(52) U.S. Cl. ..... 81/462; 81/436; 81/180.1
(58) Field of Search ..... 81/462, 467, 180.1, 81/436, 451, 456, 58.1

(56) References Cited

U.S. PATENT DOCUMENTS

| | | | | | |
|---|---|---|---|---|---|
| 735,251 | A | | 8/1903 | Harrison | |
| 1,058,654 | A | | 4/1913 | Barber | |
| 1,331,824 | A | | 2/1920 | Powers | |
| 2,632,486 | A | * | 3/1953 | Fetsko | 81/462 |
| 2,679,270 | A | | 5/1954 | Krause | |
| 2,745,448 | A | * | 5/1956 | Leake | 81/462 |
| 4,015,490 | A | * | 4/1977 | Burrous | 81/462 |
| 4,375,772 | A | * | 3/1983 | Brackett et al. | 81/462 |
| 5,370,022 | A | * | 12/1994 | Rodriguez et al. | 81/462 |

* cited by examiner

*Primary Examiner*—Lee D. Wilson
(74) *Attorney, Agent, or Firm*—Renner, Otto, Boisselle & Sklar, LLP

(57) ABSTRACT

Threaded fasteners that are tightly seated can be removed or installed easily using a tool constructed following the precepts of the present invention. The tool includes a pivot that can be releasably secured to any fixed object close to the fastener to be removed. A lever is pivotably connected to the pivot at its far end, and its near end has a handle for pressing downward on the lever. The drive assembly Is slidable along the length of the lever and can be aligned with the screw or fastener to be turned. The drive assembly includes a bit to engage the fastener, and the lever is used to press the bit tightly into the head of the screw. The drive assembly is rotatable, and maybe turned by a conventional tool such as a socket wrench or a box wrench. In this way, screws which are awkwardly located or are part of equipment that would be damaged by a slipping bit can be readily installed or removed.

18 Claims, 4 Drawing Sheets

FASTENER REMOVAL AND INSTALLATION TOOL

FIELD OF THE INVENTION

The present invention relates to a tool for the removal or installation of threaded fasteners, particularly for use in situations where it is important that a bit driving the fastener not slip from the head of the fastener.

BACKGROUND OF THE INVENTION

Many threaded fasteners require a bit to be pressed firmly into a socket on the fastener in order to loosen or tighten the fastener. This is especially true when the fastener is driven by a bit that engages a socket with inclined surfaces such as are formed on the heads of Phillips head screws. Difficulties may be encountered in keeping a tool such as a Phillips bit screwdriver in place. Difficulties may be encountered even when the driven surfaces of the fastener socket are straight walled such as Allen or other socket head screws. The bit driving the fastener can slip out when torque is applied especially when the axis of the bit is misaligned with the axis of the fastener. When the bit slips out of the screw head, it may cause damage to surrounding components. Further, workers who must press downward with considerable pressure on a screwdriver or other tool to keep it from popping out of the head of a screw may find the task difficult, awkward, or injurious. The recognition of these problems arose in the context of removing screws from the surfaces of missiles or aircraft, for example, to remove cover plates to obtain access to interior components, but the solution to these problems has much broader applications.

SUMMARY OF THE INVENTION

The tool is used to turn a threaded fastener while assuring that the bit that engaging the fastener does not slip out of the head of the fastener. This reduces the risk of damaging surrounding components. The tool includes any one of a variety of pivot assemblies, and which one is used depends upon what nearby surfaces are available to mount the pivot assembly. Generally, the pivot assembly may be screwed into a surface adjacent the screw to be turned. A lever is connected to the pivot assembly. The lever carries a hub assembly which is slidable along the length of the lever, and the lever has a handle at one end. The pivot assembly allows the lever to sweep in a circle about its axis and also to be lifted up and down with respect to the surface which holds the screw to be turned. The hub assembly includes a drive end which may be either an integrally formed bit or a conventional attachment for an interchangeable bit. The hub assembly also includes driven surfaces to allow a conventional wrench to be used to turn the bit. In use, the hub assembly is positioned over the screw to be turned with the bit aligned with the screw. Thereafter the worker presses the handle of the lever downward to hold the bit properly aligned and correctly seated in the head of the screw. Once properly positioned, the bit is turned by using a wrench on the hub assembly.

DESCRIPTION OF THE INVENTION AND ITS PREFERRED EMBODIMENTS

Figure 1:
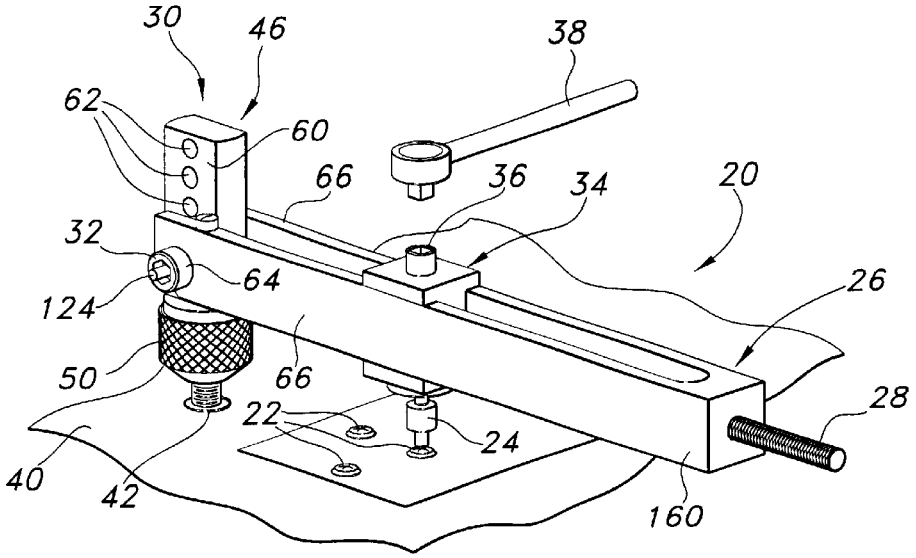
FIG. 1 is a perspective illustration showing a tool made following the precepts of the present invention and used to turn a screw.
Figure 2:
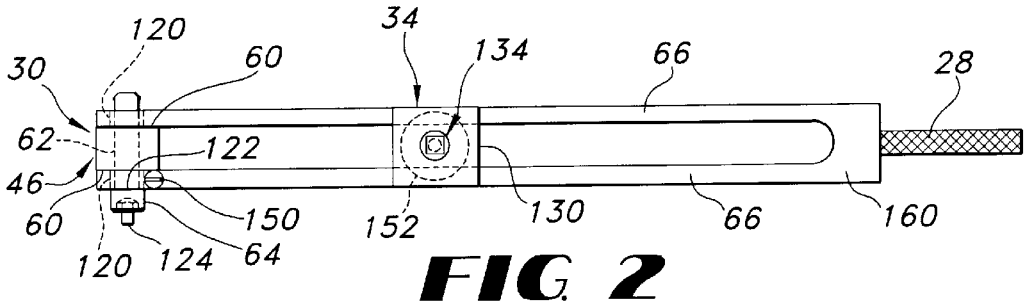
FIG. 2 is a top plan to of the tool of FIG. 1.
Figure 3:
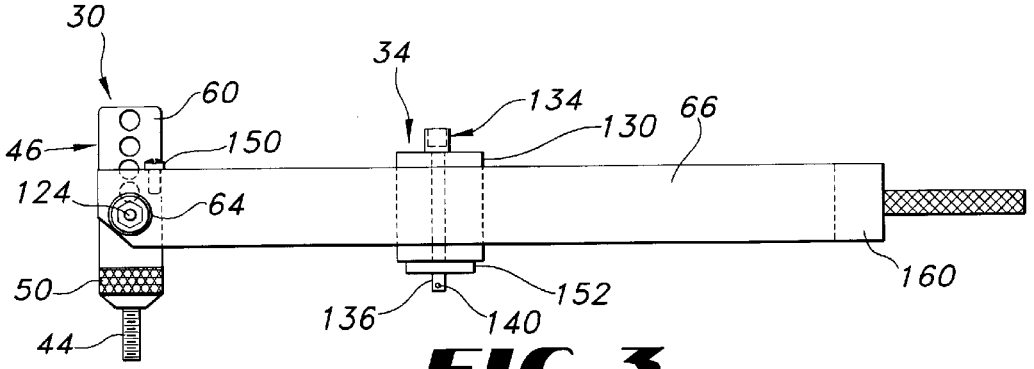
FIG. 3 is a side elevation view of the tool of FIG. 1.

A tool 20 (FIG. 1) designed according to the precepts of the present invention may be used to install and/or remove a threaded fastener 22 where it is important that the bit 24 driving the fastener not slip out of the fastener's head. Such a tool is also useful where it may be difficult, for example because of cramped quarters, to apply enough axial force to the driving tool to loosen or tighten the fastener.

A tool 20 constructed using the present invention has a lever 26 with a handle 28 at the near end. The far end of the lever 26 is connected to a pivot assembly 30 that can be secured to any suitable surface. A pin 32 connects the lever 26 to the pivot assembly 30 so the lever may rotate about the axis of the pin. A hub assembly 34 slides along the length of the lever 26 and carries a bit 24 selected to drive the fastener 22. In the tool 20 shown in FIG. 1, the hub assembly 34 also has a socket 36 that can receive a drive tool 38 such as a male socket wrench that can be used to rotate the bit 24 once it is fitted into the fastener 22. The pivot assembly 30 is rotatable about an axis parallel to the axis of the fastener to be removed. This together with the fact that the hub assembly is slidable along the length of the lever 26 enables the tool to reach any fastener 22 within its ambit.

In use, the pivot assembly 30 is secured in place, and an appropriate bit 24 is fitted to the hub assembly 34. The bit 24 is aligned with the fastener 22 to be removed by positioning the lever 26 and the hub assembly 34 on the lever in alignment with the target fastener 22. The worker then grips the handle 28 and presses down, forcing the bit 24 to seat in the head of the fastener 22. The lever 26 increases the force applied to the fasteners head. Thereafter the hub assembly 34 may be turned to loosen or tighten the fastener 22.

As used in this application the term "screw" is used in its broad sense to mean any threaded fastener such as fasteners for use with a straight bladed 10 screwdriver, for use with a Phillips head screwdriver, socket head machine screws such as Allen screws, Torx 7 screws, and the like, or any other threaded fastener including those with external drive faces such as ordinary hex head machine screws.

Also, for convenience in this description, the terms "up", "down", "horizontal", "vertical", and the like are used with the assumption that the tool 20 is oriented with the lever 26 roughly in a horizontal plane while the axis of the screw 22 to be turned is vertical. It will be appreciated that the screw 22 may be oriented differently and that the tool 20 may therefore be used in a different orientation.

Further, the terms "near" and "far" are used in relation to the handle 28 of the lever 26 which, as described below, is held by a worker to apply a load to the bit 24 driving the screw 22 to be removed or installed. While the description that follows discusses use of the present invention to loosen or remove a fastener, it will be evident that a tool using the present invention could as well be used for tightening or installing fasteners and both of these operations are included in the term "turning" a screw or fastener.

The pivot assembly 30 is adapted to be mounted to any convenient surface. Typically, the pivot assembly 30 is mounted to a surface 40 that is substantially coplanar with the surface in which the screw 22 to be removed is located. Further, typically, the surface 40 to which the pivot assembly 30 is mounted has an accessible, threaded opening 42 to secure the pivot assembly in place. In this situation, a pivot assembly 30 like that shown in FIGS. 1–6 may conveniently be used. This pivot assembly 30 includes a body 46, a capture nut 50, and a quick release pin 64.

The pivot assembly 30 shown in FIGS. 1–6 is designed to utilize a standard threaded fastener 44, which can be replaced or exchanged for one of a different size as needed. To this end the lower end portion of the pivot body 46 (FIG. 5) has external threads 48. The capture nut 50 (FIG. 4) fits over and engages the threads 48. The capture nut 50 is used to hold the selected threaded fastener 44 in place.

The capture nut 50 has a central through-bore 52 and an internal counterbore 54. The fastener 44 is selected to fit a threaded opening 42 (FIG. 1) in the surface 40. This fastener 44 (FIG. 4) is placed through the bore 52 in the capture nut 50 with its threaded end extending outward and its head housed in the counterbore 54. Typically, this fastener 44 is provided with a hex recess 56 in its head and a matching hex bit (not shown) is placed in the recess 56 and also into an internal hexagonal passage 58 in the pivot body 46.

When the capture nut 50 is threaded onto the lower end portion of the pivot body 46, the hex bit engages both the pivot body and the selected fastener 44 to prevent the selected fastener from rotating with respect to the pivot body. Once assembled with the proper fastener, the pivot assembly 30 (FIG. 1) may then be screwed into the threaded opening 42 in the surface. As a result the body 46 of the pivot assembly 30 extends outward from the surface 40 substantially perpendicular to it.

The body 46 (FIGS. 5 and 6) is formed from a cylinder with threads 48 at its lower end and opposed parallel flats 60 (FIG. 6) machined into the pivot body above the threads. A series of transverse bores 62, each of a different height above the threads 48, extend between the flats 60. Five bores 62 one-half inch apart are shown, but more or fewer bores may be used, and the spacing may be closer together or farther apart. The pivot body 46 may be taller or shorter than shown.

A quick release pin 32 (FIGS. 1–3) connects the lever 22 to the pivot body 46. The pin 32 may be installed through any of the bores 62 to change the height of the lever 26 relative to the screw 22 being turned. The width of the pivot body 46 in the direction of the bores 62 is approximately the same as the spacing between two rails 66 which form part of the lever 26. Accordingly, the pivot body 46 can easily fit between the rails 66, positioning the lever 26 at the desired height above the surface 40.

Figure 7:
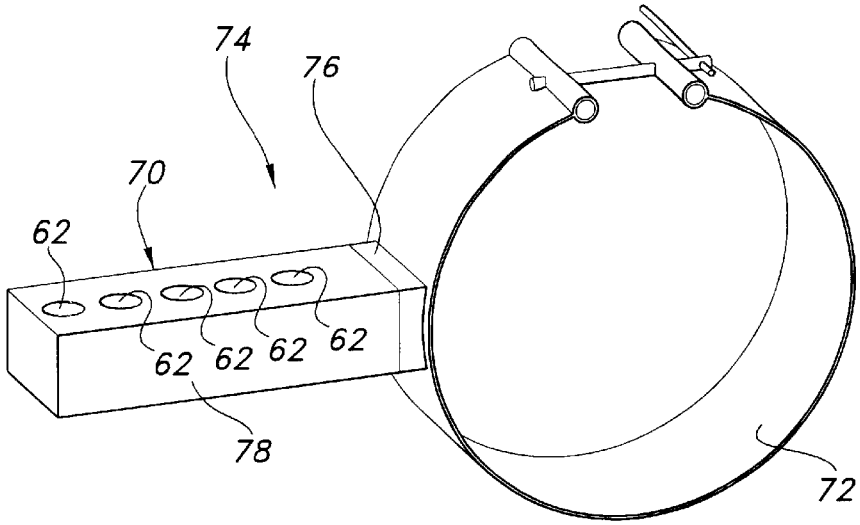
FIG. 7 is a perspective illustration of an alternative component for use in the tool of FIG. 1.

The pivot assembly 30 described above is exemplary only. Depending on the particular application, any of a variety of pivot assemblies are possible. Exemplary alternative pivot assemblies are shown in FIGS. 7, 8, 9 and 10. In FIG. 7 the pivot body assembly 70 is connected to a band 72 similar to a hose clamp. The band 72 can be tightened around a circular object to position the pivot assembly 74 as desired. In this case the pivot body assembly 70 is made in two parts, a lower part 76 and an upper part 78. The upper part 78 is free to rotate with respect to the lower part 76 about an axis that extends radially from the object around which it is clamped. This allows a lever 26 to swing into alignment with the screw 22 that is to be turned.

Figure 8:
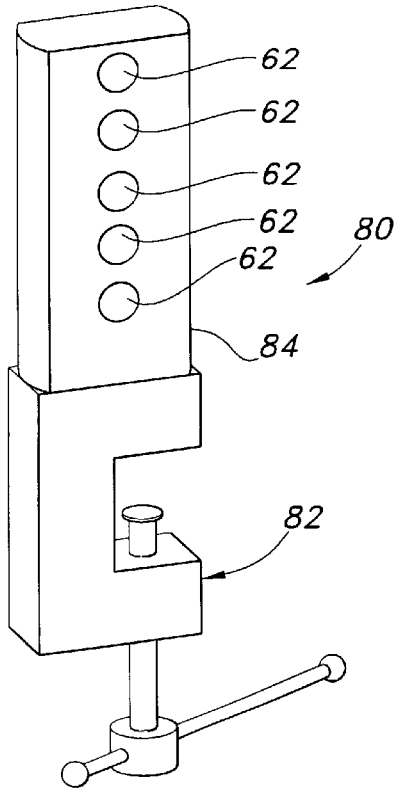
FIG. 8 is a perspective illustrate illustration of another alternative component for use in the tool of FIG. 1.

FIG. 8 illustrates another pivot assembly 80, in this case including a C-clamp 82 that can be fastened to a fixed flange. The pivot body 84 of the pivot assembly 80 is rotatable with respect to the C-clamp 82 to allow for proper alignment of the lever 26 with the screw 22 to be turned.

Figure 9:
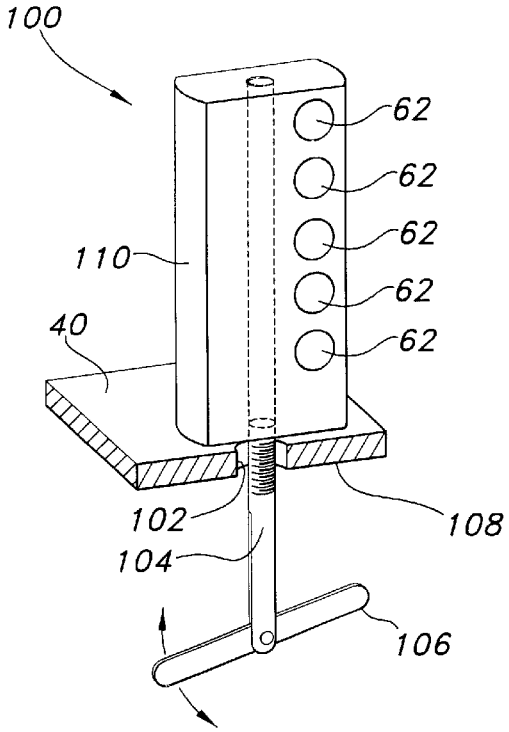
FIG. 9 is a perspective illustration of another alternative component for use in the tool of FIG. 1.

FIG. 9 illustrates another pivot assembly 100 with another technique for mounting it. In this case no threaded opening in the surface 40 is available, but a passage 102 through the surface is available. The pivot assembly 100 includes a pin 104 with a rotatable retainer bar 106. The retainer bar 106 and pin 104 are in axial alignment as they are inserted through the opening 102 in the surface. Thereafter the retainer bar 106 is rotated (either by spinning it or by a cam (not shown)) and pulled up hard against the inside surface 108 of the wall. At that point the pivot body 110 can be screwed onto the pin 104.

Figure 10:
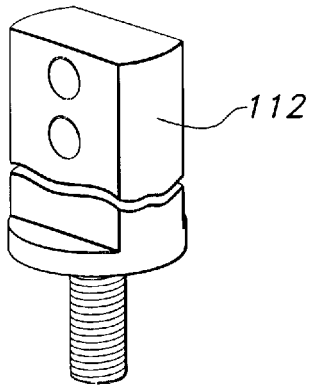
FIG. 10 is a perspective illustration of another alternative component for use in the tool of the FIG. 1.

FIG. 10 illustrates another pivot assembly, in this case an integrally formed pivot body and threaded fastener 112. The pivot 112 may be desirable where the tool 20 will always be used in a single application.

Any of the various pivot assemblies 30, 74, 80, 100 and 112 can be used in connection with the present invention. It should be evident that the tool 20 can be used with the pivot assembly 30, 74, 100 or 112 connected to an opening in the same surface 40 (FIG. 1) on which the screw 22 to be removed is located. However, the tool 20 could also be used when the pivot assembly 30, 74, 80, 100 is mounted to some other fixed surface above, below, or beside the surface from which the subject screw 22 extends. In each instance, it is important that the transverse bores 62 through the pivot bodies 46, 78, 84, 110 be the oriented in a manner that allows the bit 24 to be positioned substantially coaxial with the fastener 22 to be removed.

Figure 6:
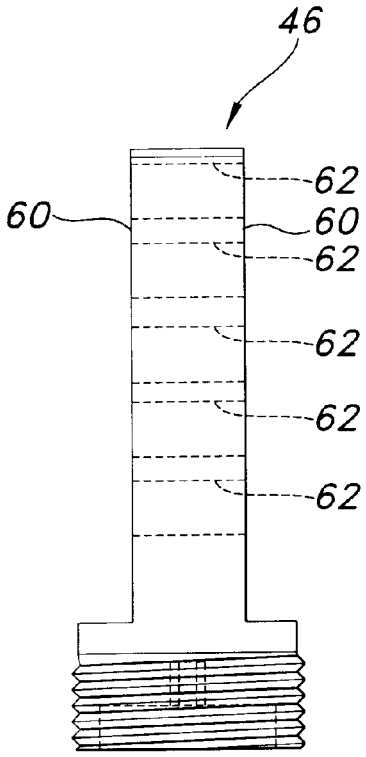
FIG. 6 is a front elevation view of the component of FIG. 5.
Figure 5:
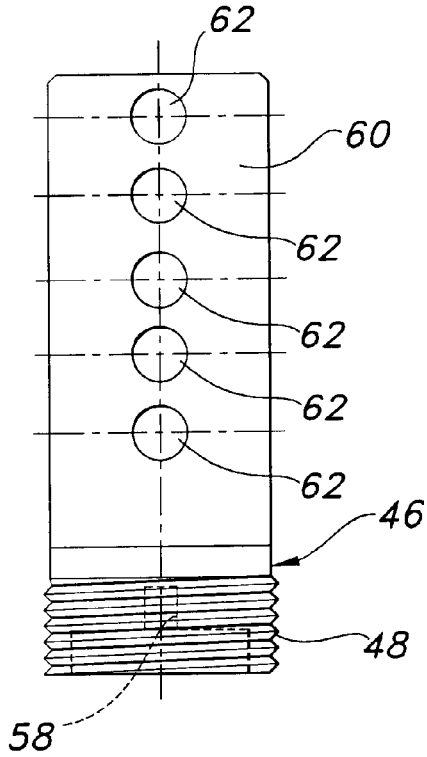
FIG. 5 is a side elevation view of another component of the tool of FIGS. 1–3.
Figure 4:
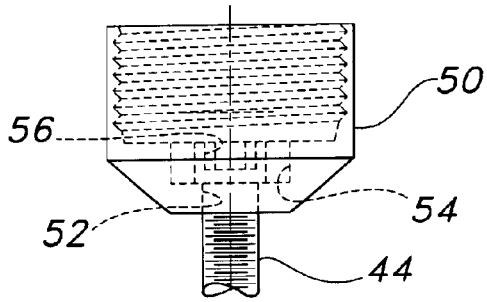
FIG. 4 is a side elevation view of a component of the tool of FIGS. 1–3.

All of the pivot arrangements shown in FIGS. 1 and 4–10 allow the pivot assembly to rotate about an axis perpendicular to the axes of the transverse bores 62. This enables the lever 26 to sweep in a circle about the pivot to reach any fastener within its ambit. The pivot assembly 46 is illustrated in FIGS. 4, 5, and 6 is enabled to rotate because the machine screw 44 used to hold that in place is not tightly turned into the threaded passage that receives it. In other embodiments, the pivot body may be an assembly with a suitable joint between two members, e.g., 76, 78 (FIG. 7) and 82, 84 (FIG. 8), allowing for rotation of one with respect to the other.

The lever 26 (FIG. 1) is formed with two rails 66 with rectangular sections joined at their near ends and fitted with a handle 28. The rails 66 extend parallel to each other from the near end portion of the lever 26. The rails 66 have coaxial bores 120 at their far ends that are the same diameter as the bores 62 through the pivot body 46 so that the pivot pin 32 may be inserted through the bores 120 in the rails and any one of the bores 62 in the pivot body 46 to make a hinged connection between the lever 26 and the pivot assembly 30. The pin 32 is inserted in the one of the bores 62 in the pivot body that allows the bit 24 to be most nearly coaxial with the screw 22 to be removed.

The pivot pin 64 (FIGS. 1–3) may be any suitable pin, but it is preferably a quick release pin. Such a pin is conventional and has a shoulder 122 at one end that limits movement in one direction. At the other end a retractable ball (not shown) limits movement in the other direction unless a spring-loaded actuator 124 is moved to allow the ball to retract.

Figure 14:
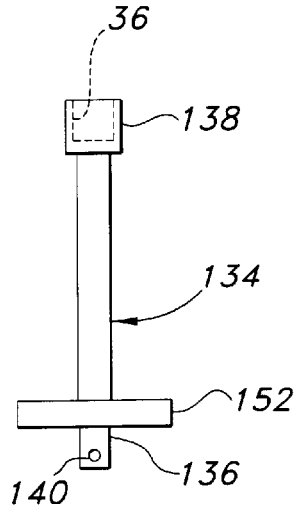
FIG. 14 is a elevation view of a drive shaft forming part of the hub assembly of FIG. 1.
Figure 11:
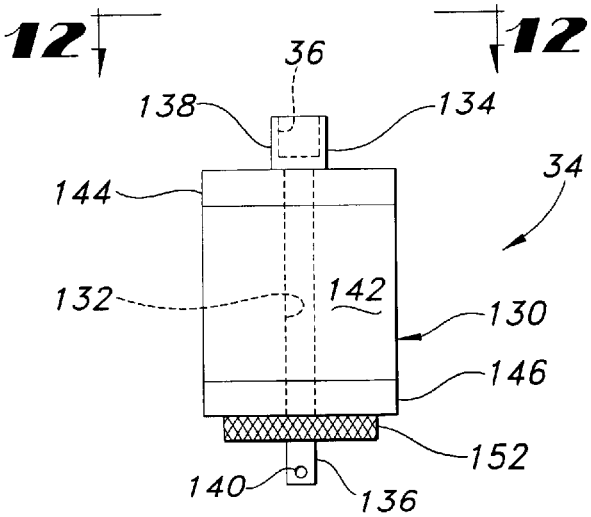
FIG. 11 is a side elevation view of a hub assembly which forms part of the tool of FIG. 1.
Figure 13:
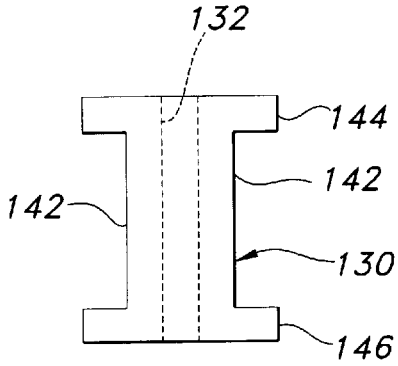
FIG. 13 is a side elevation view of a bearing body forming a part of the hub assembly of FIG. 1.

The rails 66 support the hub assembly 34 and allow it to slide to any desired position along the length of the rails. The hub assembly 34 (FIGS. 11 and 13) includes a bearing body 130 with a central bore 132, and a drive shaft 134 is rotatably mounted in the bearing body. The drive shaft (FIGS. 11 and 14) 134 has a drive end 136 and a driven end 138. The driven end 138 of the drive shaft 134 may conveniently include a socket 36 shaped to receive a male, square socket driver 38 (FIG. 1). However, the driven end 138 (FIG. 11) could also have an external shape adapted to be driven, such as an external square shape, or an external hexagonal shape. Alternatively, the driven end 138 of the drive shaft could also have and eight or 16 pointed surface to accommodate a conventional box wrench or other wrench.

The drive end 136 of the drive shaft 134 may be shaped to receive a conventional tool bit. For example, the drive end 136 may have a square end portion to fit a conventional socket bit. In one embodiment the drive end 136 is a one-quarter inch square with a conventional spring-loaded ball 140 to retain a conventional bit in place. However, the drive shaft drive end 136 could also be larger or smaller depending upon the application for the tool using the present invention. Further the drive end 136 could be formed with the desired bit shape, or could be formed with a hexagonal socket to receive a conventional bit. It is only necessary that the drive end 136 either be or accommodate a bit which will properly engage the screw 22 to be turned.

As described, the hub assembly 34 (FIG. 1) is made to be slidable along the length of the lever 20 between its near end portion and far end portion until it is aligned with the screw 22 to be removed. The pivot pin 32 location in the pivot assembly 30 is selected so that the rails 66 of the lever 26 lie in a plane that is approximately perpendicular to the axis of the screw 22 to be turned. This guarantees that when the lever 26 is pressed downward to apply force to the screw 22, the force is directed along the axis of the screw. This keeps the drive bit 24 where it belongs, in the head of the screw 22.

Figure 12:
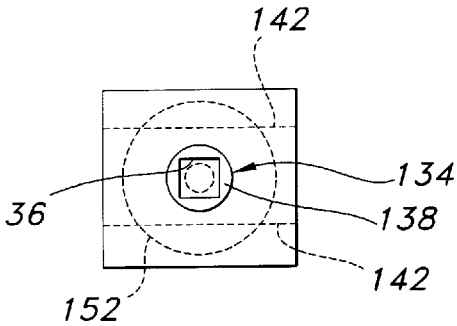
FIG. 12 is a top plan view of the hub assembly of FIG. 11.

The bearing body 130 (FIGS. 11–13) has surfaces 142 that fit between the rails 66 so that it may slide along the length of the rails. The bearing body 130 also has a top plate 144 and a bottom plate 146 fixed above and below the rails 66, respectively. In this way the bearing body 130 is trapped vertically between the rails but is free to slide lengthwise. A stop screw 150 (FIGS. 2 and 3) is provided at the far end of one rail 66 to keep the bearing body 130 from sliding off the tool when the pivot assembly 30 and pivot pin 32 are removed.

If the tool 20 is to be used in orientations other than with the lever substantially horizontal, it may prove convenient to provide a friction device (not shown) to maintain the hub assembly 34 in a selected position. Such a device may include a set screw, a spring-loaded friction pad, or simply a tight fit between the hub assembly 34 and the rails 66. Alternatively, the top surfaces of the rails could be made with a series of ridges or dimples, and the bearing body could be equipped with a spring-loaded detent ball to engage with the top surface of the rails.

The drive shaft 134 (FIGS. 2, 3, 11 and 12) extends through the bore in the bearing body. At its lower end the drive shaft has a circular disk 152 that extends radially outward. The drive end 136 portion of the drive shaft extends below the disk, and it may include a conventional spring-loaded detent ball 140 (FIG. 11) used to hold conventional tooling in place. The drive shaft is manufactured in two pieces and assembled after it is placed through the bore 132 in the hub 130. This assembly can be accomplished either by welding the pieces together or through the use of appropriate press-fit tooling pins.

The circular disk 152 at the lower end of the drive shaft 134 bears against the bottom plate 146 of the bearing body 130 to transfer axial loads from the lever 22 through the bearing body to the drive shaft when the drive shaft is turned. The tool 20 may include a friction reducing device (not shown) such as a bronze thrust washer, a thrust roller bearing, or a tapered roller bearing, by way of example. In some situations, a grease or oil fitting may be provided to assure that the drive shaft turns as freely as possible. The outer periphery of the drive shaft disk 152 may be knurled to enable easy manual rotation of the drive shaft.

The hub assembly 34 shown in the Figures has a rectangular exterior shape and a separate rotatable drive shaft 134. Other arrangements are possible. For example the bearing body could be eliminated and the drive shaft diameter enlarged to equal the spacing between the rails 66. Such a drive shaft would have circular flanges at its upper and lower ends to capture it between the rails. While the friction of these flanges bearing against the bottom of the rails may be undesirable in some applications, this can be addressed through the use of various bearing arrangements, or simply ignored depending upon the particular application.

The two rails 66 (FIGS. 1 and 3) are joined together forming a base 160 (FIGS. 1–3) at their near end, and the handle 28 extends outward from the base, centered between the two rails. With this arrangement, when a worker presses downward on the handle 28, a load is evenly carried on the two rails 66 through the bearing body 130 to the drive shaft 134 and from the drive shaft to the screw 22 to is be removed. Other arrangements are possible. For example the rails 66 could be made of round shafts. In this case the bearing body would have parallel bores to slide along the rails and a perpendicular bore for the drive shaft.

In use, the pivot assembly 30 (FIG. 1) is secured to an appropriate surface 40. A bit 24 is selected and installed on the drive end 136 (FIG. 11) of the drive shaft 134. Then the pin 32 (FIG. 1) is used to secure the lever 26 to the pivot assembly 30 at the one of the holes 62 that most nearly allows the bit 24 to be coaxial with the screw 22 to be turned. The hub assembly 34 is then positioned lengthwise on the lever 26 so that the bit 24 fits the head of the screw 22 to be turned, and the worker presses down on the lever and attaches the desired driver such as a ratchet 38 or other tool to turn the drive shaft 134. The force on the lever 26 and correct alignment of the bit 24 coaxial with the screw 22 to be turned make it difficult or impossible for the bit to slip out of the screw head.

Thus it is clear that the present invention provides a unique and flexible tool for turning fasteners.

What is claimed is:

1. A tool for use in turning a fastener that extends through a surface, the tool comprising:

a lever having an axis and a near end and a far end at opposite ends along the axis, a removable pivot assembly mountable in a fixed position relative to the surface, the pivot assembly including a body having two segments rotatable with respect to each other, a first segment having a plurality of openings therethrough and a second segment including means for securing the second segment in a fixed position relative to the fastener to be turned, a pin for pivotably connecting the far end portion of the lever to a selected one of the openings in the pivot assembly at a selected height above the surface of the lever, a handle at one end portion of the lever, a hub assembly slidable along the length of the lever, at least a portion of the hub assembly being rotatable with respect to the lever, the hub assembly having a driven end shaped to accept a tool for rotating the rotatable portion of the hub assembly and a drive end shaped to drive the fastener.

2. The tool of claim 1 wherein the second segment of be body of the pivot assembly includes a threaded end portion that may be secured to an opening in the surface.

3. The tool of claim 2 wherein the threaded end portion includes at least a part of a machine screw, the machine screw being secured against rotation with respect to the second segment of the pivot assembly.

4. The tool of claim 3 the machine screw is removeably secured to the body of the pivot assembly.

5. The tool of claim 2 wherein the threaded end portion is integrally formed with the body.

6. The tool of claim 4 wherein the pivot assembly includes a capture nut threaded to one end portion of the pivot assembly, the capture nut engaging the machine screw.

7. The tool of claim 6 wherein the pivot assembly includes a key for securing the machine screw against rotation with respect to the second segment of the pivot assembly.

8. The tool of claim 1 wherein the lever includes a pair of parallel rails and the hub assembly includes surfaces for engaging the rails and transmitting loads normal to the length of the rails.

9. The tool of claim 6 wherein the hub assembly includes a body having a bore extending perpendicular to the axis of the lever, and a driveshaft rotatably mounted in the body, the driveshaft including said driven end and said drive end.

10. The tool of claim 9 wherein the driven end is configured to be engaged by a conventional hand tool.

11. The tool of claim 9 wherein the drive end includes a bit shaped to engage the fastener to be removed, the bit being integrally formed with the drive shaft.

12. The tool of claim 9 wherein the drive end of the driveshaft is shaped to accept conventional bits.

13. The tool of claim 12 wherein the drive end of the shaft has a square male shape to fit a conventional socket wrench.

14. A method of turning a screw including providing a tool as set forth in claim 1, mounting the pivot assembly in a fixed position with respect to the screw to be turned, connecting the lever to the pivot assembly using the pin, sliding the hub assembly along the lever to a location aligned with the screw to be removed, selecting a bit appropriate to the screw to be turned and mounting the bit on the drive end of the hub assembly, pressing on the lever to force the bit into the screw to be turned, and turning the driven end of the hub assembly with a tool.

15. The method of claim 14 wherein the step of connecting the lever to the pivot assembly includes inserting the pin through the one of the openings in the first segment that results in the axis of the rotation of the hub assembly being most nearly coincident with the axis of the fastener to be turned.

16. The tool of claim 1 wherein the securing means includes a flexible band that may be tightened around a fixed structure.

17. A tool for use in turning a fastener that extends through a surface, the tool comprising:

a lever having an axis and a near end and a far end at opposite ends along the axis, a removable pivot assembly mountable in a fixed position relative to the surface, a pin for pivotably connecting the far end portion of the lever to the pivot assembly, a handle at one end portion of the lever, hub assembly slidable along the length of the lever, at least a portion of the hub assembly being rotatable with respect to the lever, the hub assembly having a driven end shaped to accept a tool for rotating the rotatable portion of the hub assembly and a drive end shaped to drive the fastener;

wherein the pivot assembly includes a body, the body including two segments rotatable with respect to each other, the pivot assembly includes securing means for securing the pivot assembly in a fixed position with respect to the fastener to be turned, the securing means being connected to one of the segments and the other of the segments includes means for mounting the lever at any of a plurality of heights above the surface, and the securing means includes a C-clamp.

18. A tool for use in turning a fastener that extends through a surface, the tool comprising:

a lever having an axis and a near end and a far end at opposite ends along the axis, a removable pivot assembly mountable in a fixed position relative to the surface, a pin for pivotably connecting the far end portion of the lever to the pivot assembly, a handle at one end portion of the lever, a hub assembly slidable along the length of the lever, at least a portion of the hub assembly being rotatable with respect to the lever, the hub assembly having a driven end shaped to accept a tool for rotating the rotatable portion of the hub assembly and a drive end shaped to drive the fastener, wherein the pivot assembly is selected from the group comprising:

a body and a threaded end portion having at least a part of a machine screw, the machine screw being secured against rotation with respect to the body of the pivot assembly;

a body and a threaded end portion having at least a part of a machine screw, the machine screw being secured against rotation with respect to the body of the pivot assembly, the screw being removeably secured to the body of the pivot assembly;

a body and a threaded end portion having at least a part of a machine screw, the machine screw being secured against rotation with respect to the body of the pivot assembly, the threaded end portion being integrally formed with the body;

a body and a threaded end portion having at least a part of a machine screw, the machine screw being secured against rotation with respect to the body of the pivot assembly, the pivot assembly including a capture nut threaded to one end portion of the pivot assembly, the capture nut engaging the machine screw;

a body and a threaded end portion having at least a part of a machine screw, the machine screw being secured against rotation with respect to the body of the pivot assembly, the pivot assembly including a key for securing the machine screw against rotation with respect to the pivot assembly;

a body with an end portion securing means for securing the pivot assembly in a fixed position with respect to the fastener to be turned;

a body with an end portion having at least a part of a machine screw, the machine screw being secured against rotation with respect to the body;

a flexible band that may be tightened around a fixed structure; and a C-clamp.

* * * * *

UNITED STATES PATENT AND TRADEMARK OFFICE

CERTIFICATE OF CORRECTION

PATENT NO. : 6,807,884 B2
DATED : October 26, 2004
INVENTOR(S) : Eric N. Sillman It is certified that error appears in the above-identified patent and that said Letters Patent is hereby corrected as shown below:

Title page,
Item [73], Assignee, should be -- Raytheon Company -- not "Raytheon Corp".

Signed and Sealed this

Twenty-fifth Day of October, 2005

JON W. DUDAS
*Director of the United States Patent and Trademark Office*